US006715163B1

(12) United States Patent
Cunningham

(10) Patent No.: US 6,715,163 B1
(45) Date of Patent: Apr. 6, 2004

(54) SHOWER CURTAIN ROD

(76) Inventor: Lance Cunningham, 9917 E. 119th Pl., Bixby, OK (US) 74008

( * ) Notice: Subject to any disclaimer, the term of this patent is extended or adjusted under 35 U.S.C. 154(b) by 0 days.

(21) Appl. No.: 10/205,153

(22) Filed: Jul. 25, 2002

(51) Int. Cl.[7] ..... A47K 3/14
(52) U.S. Cl. ..... 4/558
(58) Field of Search ..... 4/558, 608–610; 160/330; 211/105.1

(56) References Cited

U.S. PATENT DOCUMENTS 1,576,077 A * 3/1926 Watson ..... 211/123
2,778,030 A * 1/1957 Goche ..... 4/608
4,068,345 A 1/1978 Hehl et al.
4,385,409 A 5/1983 File et al.
4,769,862 A 9/1988 Skrzelowski
5,022,104 A * 6/1991 Miller ..... 4/558
5,101,522 A 4/1992 Prian
5,216,766 A 6/1993 Lang
5,231,708 A * 8/1993 Hansen ..... 4/608
5,371,908 A * 12/1994 Secondine ..... 4/609
5,402,842 A 4/1995 Ruggiero
5,426,821 A 6/1995 Story
5,513,419 A * 5/1996 Zinger ..... 16/87.4 R
5,561,870 A 10/1996 Hertel
5,662,297 A * 9/1997 Christensen et al. ..... 211/105.1
6,216,287 B1 4/2001 Wise

* cited by examiner

*Primary Examiner*—Charles E. Phillips
(74) *Attorney, Agent, or Firm*—Molly D. McKay

(57) ABSTRACT

A shower curtain rod that employs a u-shaped bar mirroring the curvature of a bath tub to allow a shower curtain that attaches to the rod via ring type clamps to hang in a curved configuration, thereby reducing the chance of water splashing outside the shower area. Because the rod is continuous, i.e. has no attachment to the wall or any other structure, along the entire u-shaped portion, the side edges of the shower curtain are free to follow the u-shape of the bar as they are pulled by the user to close the shower curtain. Flexible ears are provided on each end of the u-shaped bar to hold the side edges of the shower curtain shut while allowing the curtain to be opened at either side. The rod is adjustable in length and attaches to the opposing walls of the shower by fasteners or via tension.

3 Claims, 4 Drawing Sheets

SHOWER CURTAIN ROD

BACKGROUND OF THE INVENTION

1. Field of the Invention

The present invention relates to a new type of shower curtain rod that is designed to prevent water from splashing out of the shower area and onto the wall and floor of the bathroom adjacent the shower where the constant wetting can cause damage to the wall and floor. More specifically, the present invention is a shower curtain rod that employs a u-shaped bar that follows the contours of the shower area and with which standard ring type clamps can be used to movably secure a shower curtain to the rod. The u-shape of the bar allows the side edges of the shower curtain to curve around the opposing sides of the bath enclosure so that the side edges of the shower curtain are adjacent the opposing sides of the bath enclosure and the full width of the curtain hangs straight downward within a bath tub provided in the shower area, thus providing an effective barrier to prevent water from exiting the shower area around the side edges or at the bottom of the shower curtain.

2. Description of the Related Art

One problem with having a shower in combination with a bathtub is that the shower curtain rods traditionally used are straight and are secured to opposite side walls of the shower enclosure. Because the traditional shower curtain rods are straight, the shower curtain that hangs on the rod can not be pulled around to overlap the side walls and therefore water can easily be splashed between the side edges of the curtain and the opposing side walls of the shower enclosure and onto the wall of the bathroom adjacent the shower area. Repeated wetting of the wall of the bathroom will result in damage to the wall, and water will run onto the floor from the wall, resulting in damage to the floor, also.

Also, because the user often attempts to pull the side edges of the shower curtain around to overlap the side walls, this makes the shower curtain hang sideways at the side edges and the bottom of the shower curtain is often pulled up so that the bottom of the shower curtain drapes outside the bath tub. This results in water running down the shower curtain onto the floor of the bathroom adjacent the bath tub. Repeated wetting of the floor of the bathroom will result in damage to the floor.

The present invention addresses this problem by providing a shower curtain rod that employs a unshaped bar that follows the contours of the shower area. The rod of the present invention is continuous so that standard ring type clamps can be used to movably secure a shower curtain to the rod. Because the rod is continuous, the side edges of the shower curtain are free to follow the u-shape of the bar as they are pulled by the user to close the shower curtain. Flexible ears are provided on each end of the u-shaped bar as a means to hold the side edges of the shower curtain shut once the shower curtain has been pulled shut by the user, i.e. pulled so that the opposite side edges of the shower curtain curve around the opposing sides of the bath enclosure so that the side edges of the shower curtain are adjacent the opposing sides of the bath enclosure and the full width of the curtain hangs straight downward within the bath tub provided in the shower area. With the curtain shut in this manner, it provides an effective barrier to prevent water from exiting the shower area around the side edges or at the bottom of the shower curtain.

The present invention allows the shower curtain to be opened from either side edge of the curtain by pulling the ring type clamp on one side edge of the curtain past the flexible ear provided on the u-shaped rod to release the clamp from the ear. The shower curtain is then pulled to the opposite side wall of the enclosure. This ability to open the shower curtain at either side edge differs from prior art curtain rods that permanently hold one side edge of the shower curtain so that the shower curtain can only be opened at one side edge.

Several embodiments of the present invention are illustrated and described hereafter. Each of these embodiments attaches to the opposing side walls of the shower area in a different way. One embodiment of the invention is provided with adjustable tension feet on one end of the one piece u-shaped bar as a means of expanding the length of the device to secure it between opposing side walls. A second embodiment of the invention is provided with a two piece telescoping u-shaped rod that is provided with brackets from permanently attaching the device to opposing side walls by means of screws or other similar fastenings. Another embodiment of the invention is provided with non-adjustable feet that hold the device via tension between the opposing side walls and the u-shaped rod is adjusted in length by means of either a screw mechanism provided within the rod, or alternately, by a spring mechanism provided within the rod.

Although several embodiments of the present invention are illustrated and described hereafter, the invention is not so limited and other embodiments of the invention could be made with different means of attaching the device to opposing side walls of the shower area.

SUMMARY OF THE INVENTION

The present invention is a shower curtain rod that employs a u-shaped bar that follows the curvature of a bath tub provided in the shower area. The rod of the present invention is continuous so that standard ring type clamps can be used to movably secure a shower curtain to the rod. Because the rod is continuous, i.e. not attached to a wall or other object along the entire u-shaped portion of the bar, the side edges of the shower curtain are free to follow the u-shape of the bar as they are pulled by the user to close the shower curtain.

Flexible ears are provided on each end of the u-shaped bar as a means to hold the side edges of the shower curtain shut once the shower curtain has been pulled shut by the user, i.e. pulled so that the opposite side edges of the shower curtain curve around the opposing sides of the bath enclosure and so that the side edges of the shower curtain are held adjacent the opposing sides of the bath enclosure. In this closed position, the curtain hangs straight downward within the bath tub provided in the shower area along the entire width of the curtain. With the curtain shut in this manner, it provides an effective barrier to prevent water from exiting the shower area around the side edges of the curtain and at the bottom of the shower curtain.

The present invention allows the shower curtain to be opened from either end of the rod. This is accomplished by simply pulling the curtain so that the ring type clamps on one side edge of the curtain slide past the flexible ear provided on the u-shaped rod on that end of the rod, and then continuing to pull the curtain along the rod to fully open the curtain so that it hangs adjacent the opposite side wall of the enclosure. This ability to open the shower curtain at either side edge differs from prior art curtain rods and attachments that permanently hold one side edge of the shower curtain so that the shower curtain can only be opened at an opposite side edge.

Several embodiments of the present invention are illustrated and described hereafter. Each of these embodiments attaches to the opposing side walls of the shower area in a different way. One embodiment of the invention is provided with adjustable tension feet on one end of a one piece u-shaped bar as a means of expanding the length of the device for the purpose of secure it via tension between opposing side walls.

A second embodiment of the invention is provided with a two piece telescoping u-shaped rod that is provided with brackets on each end of the rod for permanently attaching the device to opposing side walls by means of screws or other similar fastenings.

Two further embodiments of the invention are each provided with non-adjustable feet that hold the device via tension between the opposing side walls. Tension is supplied in each of these two embodiments by a u-shaped rod that is adjustable in length. One of these embodiments employs a u-shaped rod that is adjusted in length by means of a screw mechanism provided within the rod, and the other of the two embodiments employs a unshaped rod that is adjusted in length by means of a spring mechanism provided within the rod.

DETAILED DESCRIPTION OF THE PREFERRED EMBODIMENT

THE INVENTION

Figure 1:
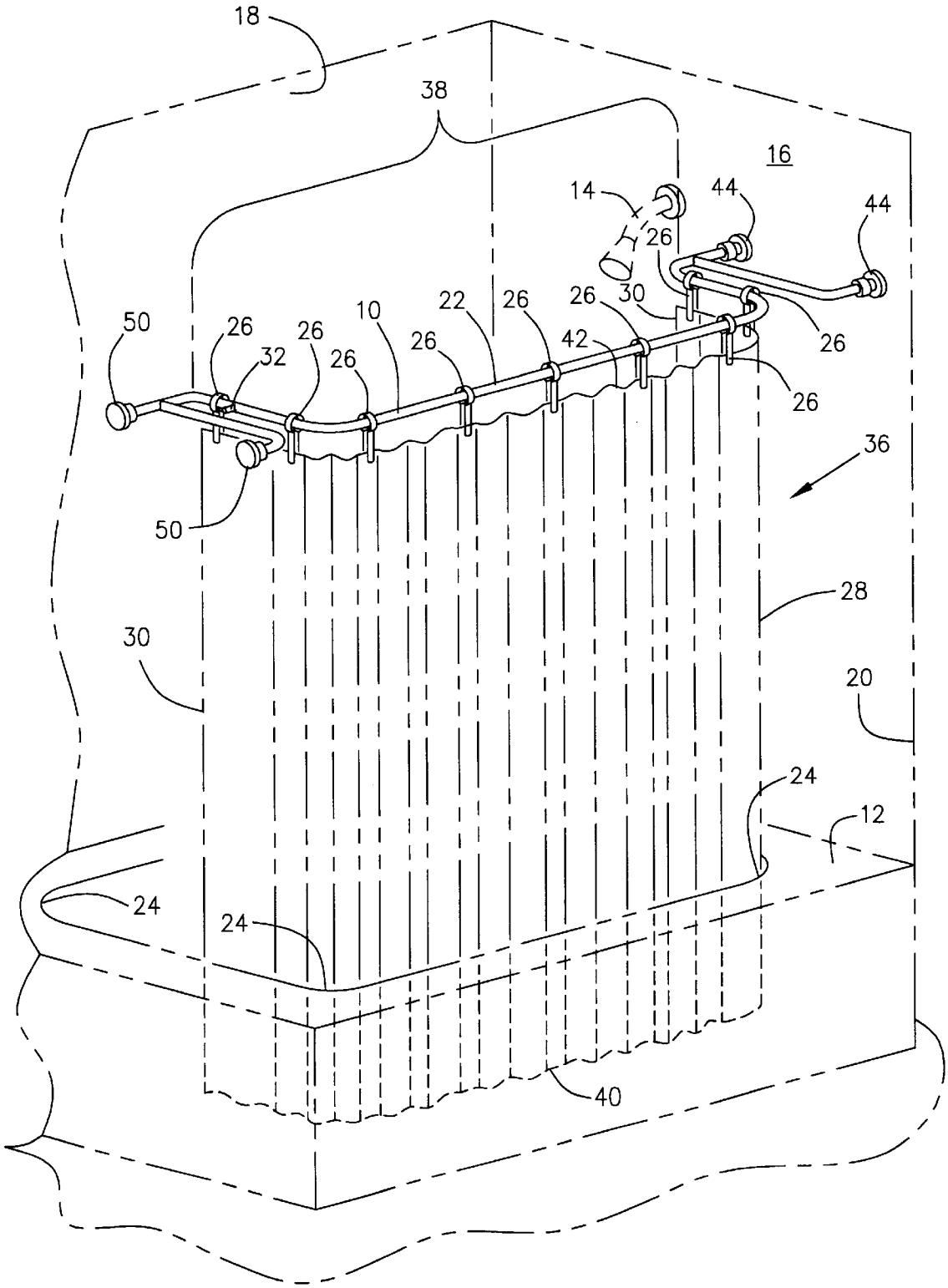
FIG. 1 is a perspective view of a bath tub and shower area shown employing a shower curtain rod constructed in accordance with a preferred embodiment of the present invention.

Referring now to the drawings and initially to FIG. 1, there is illustrated a shower curtain rod 10 that is constructed in accordance with a preferred embodiment of the present invention. The shower curtain rod 10 is shown in use with a bath tub 12 that has a shower head 14 located in a side wall 16 of the bath or shower enclosure 18 above the bath tub 12. The shower curtain rod 10 extends between opposite side walls 16 of the bath or shower enclosure 18 on an open side 20 of the bath or shower enclosure 18

The shower curtain rod 10 employs a u-shaped bar 22 that follows in curvature the curve of inside corners 24 of the bath tub 12. The u-shaped bar 22 of the rod 10, although made of one or more bar pieces, is continuous so that standard ring type shower curtain clamps 26 can be used to movably secure a shower curtain 28 to the u-shaped bar 22 of the rod 10. Because u-shaped bar 22 of the rod 10 is continuous, i.e. not attached to a side wall 16, or other object along the entire length 52 of the u-shaped bar 22, the side edges 30 of the shower curtain 28 are free to follow the u-shape of the bar 22 as the shower curtain 28 is pulled by the user to close the shower curtain 28.

Figure 13:
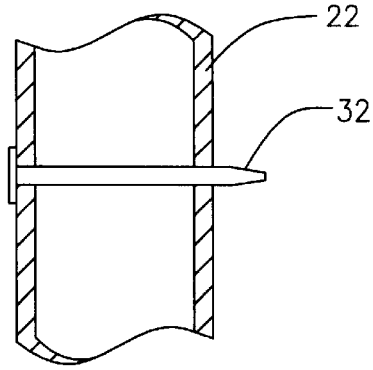
FIG. 13 is a cross sectional view of the ear shown in the circled area assigned the numeral 13 in FIG. 2.

As illustrated in FIG. 13, flexible ears 32 are provided on each end 34 of the u-shaped bar 22 as a means to hold the side edges 30 of the shower curtain 28 shut once the shower curtain 28 has been pulled shut by the user, i.e. the curtain 28 pulled so that the opposite side edges 30 of the shower curtain 28 curve around the opposing side walls 16 of the bath enclosure 18 and so that the side edges 30 of the shower curtain 28 are held so that they hang adjacent the opposing sides walls 16 of the bath enclosure 18. In this closed position 36, as illustrated in FIG. 1, the curtain 28 hangs straight downward within the bath tub 12 along the entire width 38 of the curtain, i.e. between the opposite side edges 30 of the curtain 28. With the curtain 28 shut in this manner, it provides an effective barrier to prevent water from exiting the shower enclosure 18 around the side edges 30 of the curtain 28 and at the bottom edge 40 of the shower curtain 28.

One unique aspect of the shower curtain rod 10 is that it allows the shower curtain 28 to be opened from either end of the rod 10. This is accomplished by initially pulling on the curtain 28 in a horizontally direction so that the ring type shower curtain clamps 26 attaching at the top edge 42 of one side edge 30 of the curtain 28 glide past the flexible ear 32 provided on the u-shaped bar 22 on that end 34 of the bar 22, and then continuing to pull the curtain horizontally along the rod 10 to fully open the curtain 28. Although not illustrated, when the curtain 28 is fully opened, it hangs adjacent the side wall 16 of the enclosure 18 opposite the side wall 16 from which it was displaced when opening the curtain 28. To return the shower curtain 28 to its closed position 36 so that the curtain 28 hangs across the open side 20 of the enclosure 18, this procedure is reversed. This ability to open the shower curtain 28 at either side edge 30 differs from prior art curtain rods and attachments that permanently hold one side edge 30 of the shower curtain 28 so that the shower curtain 28 can only be opened at an opposite side edge 30.

Several embodiments of the present invention are illustrated and described hereafter. Each of these embodiments attaches to the opposing side walls 30 of the shower enclosure 18 in a different way.

Figure 2:
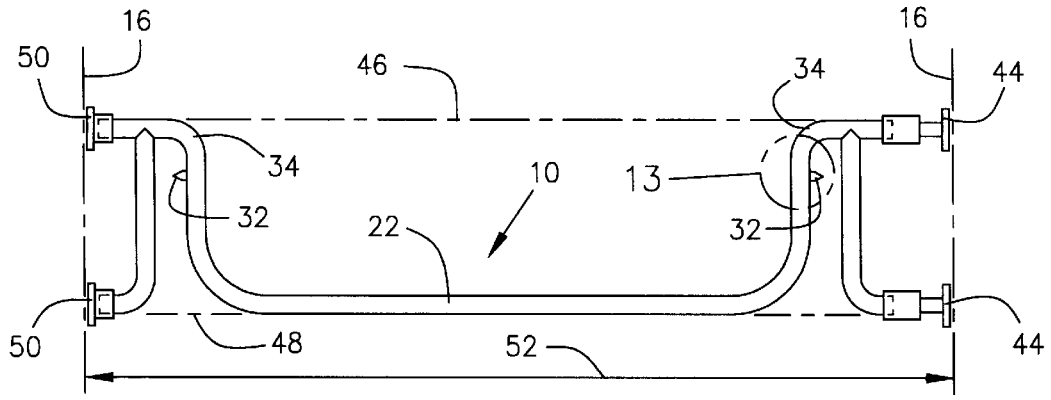
FIG. 2 is a top view of the shower curtain rod of FIG. 1.

A preferred embodiment 10 of the present invention is illustrated in FIG. 2. The preferred embodiment 10 is provided with a pair of adjustable tension feet 44 on one end 34 of a one piece or unitary u-shaped bar 22. The adjustable tension feet 44 are preferably spaced apart from each other and are located so that one tension foot 44 is provided at the inner most extension 46 of the u-shaped bar 22, as illustrated in FIG. 2, and the other tension foot is provided at the outer most extension 48 of the u-shaped bar 22, as also illustrated in FIG. 2.

Similarly positioned stationary feet 50 are provided on the opposite end 34 of the rod 10. The tension feet 44 serve to expand the total length 52 of the rod 10 for the purpose of secure the rod 10 via tension between opposing side walls 16 of the enclosure 18 by engaging the stationary feet 50 with one side wall 16 and then extending the adjustable tension feet 44 so that they push against the opposite side wall 16. Because the stationary feet 50 are spaced apart from each other and the tension feet 44 are also spaced apart from each other, the rod 10 is held tightly and can not rotate once it is installed between the opposing side walls 16 of the enclosure 18.

Referring now to FIG. 2, the u-shaped bar 22 has a bottom portion, i.e. the central part of the u-shaped bar 22, and two legs, i.e. the sides of the u-shaped bar 22. Each of the two legs of the u-shaped bar 22 attaches to the bottom portion by one end of the leg, so that one of the two legs of the u-shaped bar 22 extends laterally from one end of the bottom portion and the other of the two legs of the u-shaped bar 22 extends laterally from the other end of the bottom portion. The u-shaped bar 22 also has a J-shaped portion attached laterally to and extending from the other end of each of the legs of the u-shaped bar 22 in such a way that each leg of the J-shaped portion extends generally parallel to its corresponding laterally extending leg of the u-shaped bar 22. The J-shaped portion is that portion of the rod 10 to which the feet 50 and 44 attach, as illustrated in FIGS. 1, and 2 for the preferred embodiment rod 10, or alternately to which the brackets 54 attach, as illustrated in FIG. 3 for the alternate embodiment rod 10A, or alternately to which the feet 58 attach, as illustrated in FIGS. 4 and 5 for both the second and third alternate embodiment rods, 10B and 10C respectively.

Figure 3:
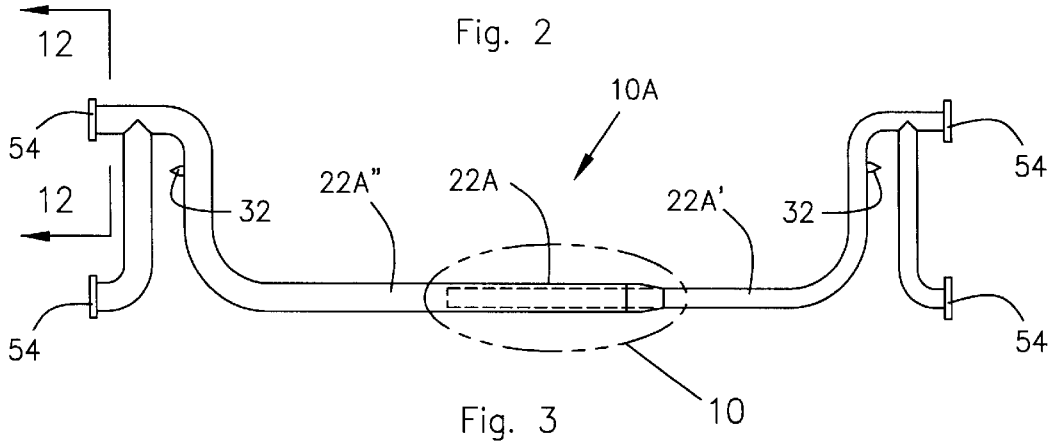
FIG. 3 is a top view of a first alternate shower curtain rod employing a telescoping mechanism to adjust the length of the rod and employing permanent attachment brackets at each end of the rod for securing the rod to the walls of the shower area.
Figure 11:
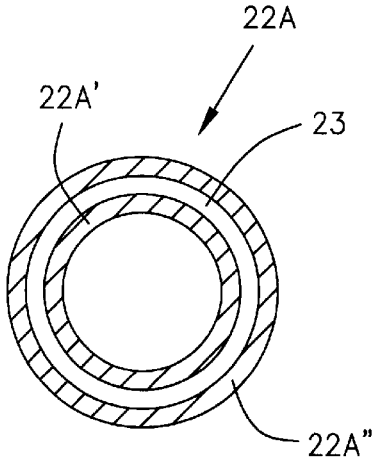
FIG. 11 is a cross sectional view of the telescoping adjustment mechanism taken along line 11—11 of FIG. 10.
Figure 10:
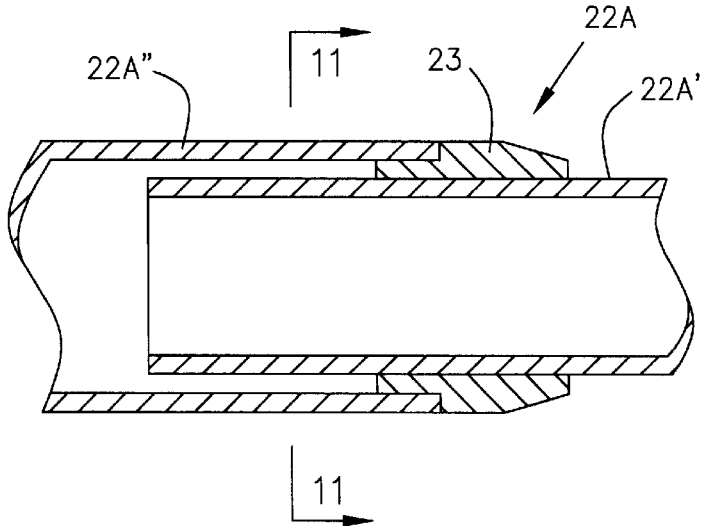
FIG. 10 is a cross sectional view of the circled area assigned the numeral 10 in FIG. 3, showing the details of the telescoping adjustment mechanism.
Figure 12:
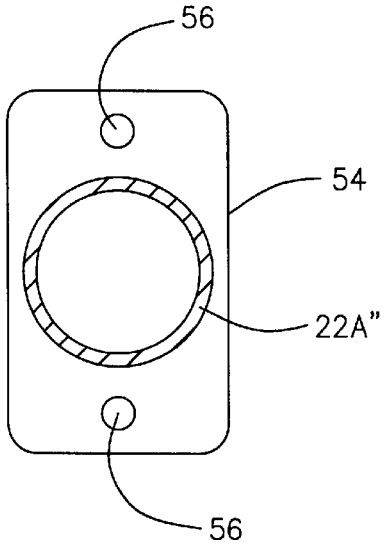
FIG. 12 is a cross sectional view of a permanent attachment bracket taken along line 12—12 of FIG. 3.

A first alternate embodiment 10A of the invention is illustrated in FIG. 3. This first alternate embodiment 10A is provided with a two-piece telescoping u-shaped bar 22A instead of the u-shaped bar 22. The details of the two-piece telescoping u-shaped bar 22A are illustrated in FIGS. 10 and 11. The two bar pieces 22A' and 22A" of the bar 22A are shown with the smaller bar 22A' adjustably movably inserting inside the larger hollow bar 22A" and held at the desired position relative to the larger bar 22A" by a tapered collar 23. The first alternate embodiment 10A is provided with two sets of attachment brackets 54, with one set of brackets 54 on each end 34A of the rod 10A instead of the stationary and adjustable tension feet 50 and 44 employed with rod 10. As illustrated in FIG. 12, openings 56 are provided in the brackets 54 through which nails, screws or other similar fasteners (not illustrated) can be inserted to permanently attach the first alternate embodiment 10A to the opposing side walls 16.

Figure 4:
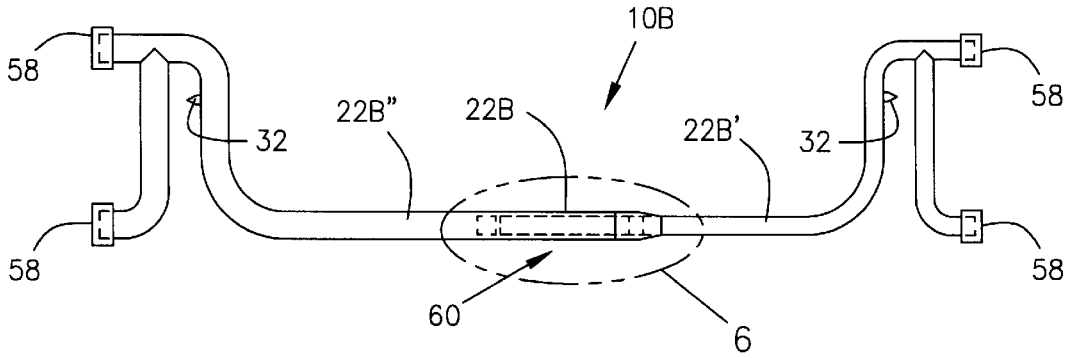
FIG. 4 is a top view of a second alternate shower curtain rod.
Figure 5:
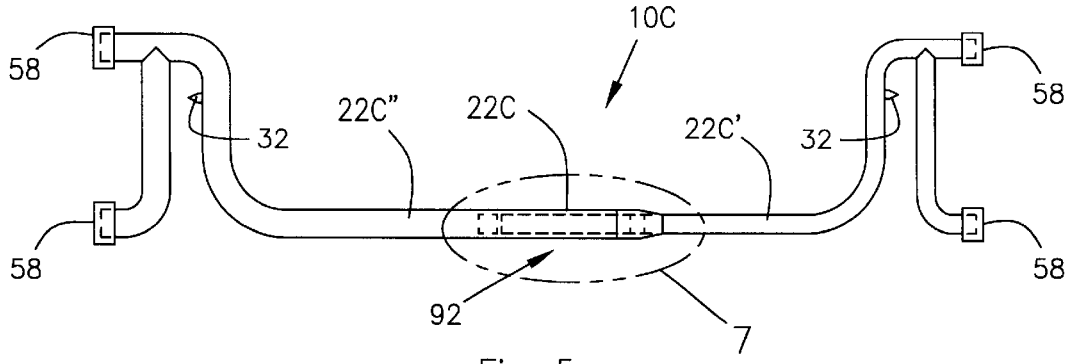
FIG. 5 is a top view of a third alternate shower curtain rod.

Two further embodiments of the invention are illustrated in FIGS. 4 and 5 respectively, i.e. a second alternate embodiment 10B and a third alternate embodiment 10C. Each of these embodiments 10B and 10C are provided with non-adjustable feet 58 that hold the device via tension between the opposing side walls 16. Tension is supplied in these two embodiments 10B and 10C respectively by a screw adjustable, two piece, u-shaped bar 22B and a two piece spring biased u-shaped bar 22C. Each of the u-shaped bars 22B and 22C is adjustable in length 52.

Figure 6:
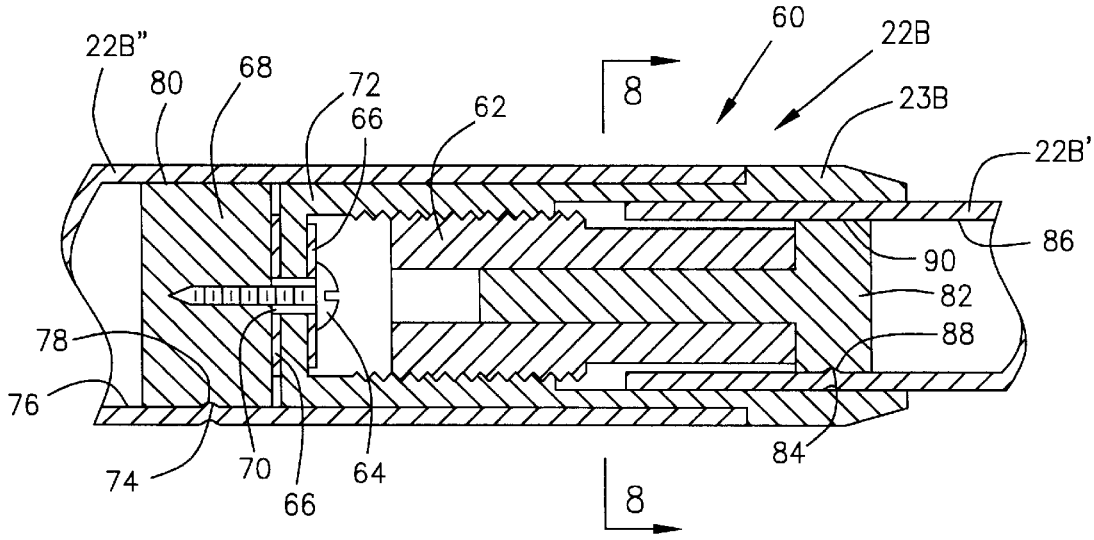
FIG. 6 is a cross sectional view of the circled area assigned the numeral 6 in FIG. 4, showing a screw type adjustment mechanism.
Figure 8:
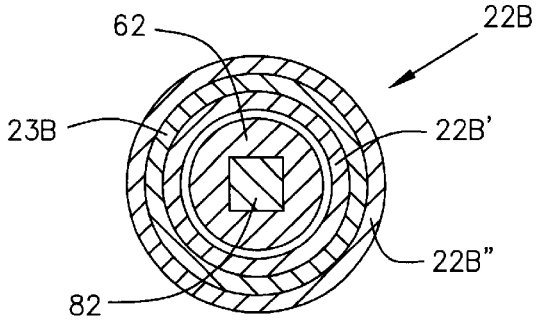
FIG. 8 is a cross sectional view of the screw type adjustment mechanism taken along line 8—8 of FIG. 6.

The second alternate embodiment 10B employs a u-shaped bar 22B that is adjusted in length 52 by means of a screw mechanism 60 provided within the bar 22B. Referring now to FIGS. 6 and 8, details of the screw mechanism 60 are illustrated.

The u-shaped bar 22B is comprised of two bar pieces 22B' and 22B" with the smaller bar 22B' inserting inside the larger hollow bar 22B" and adjustably positioned relative to the larger bar 22B" by a female threaded tapered collar 23B that adjustably engages a male threaded piston 62. The female threaded tapered collar 23B is rotatably secured to the larger bar 22B" by a fastener 64 that inserts through an opening 70 provided in one end 72 of the collar 23B and engages a plug 68 that is secured within the larger bar 22B". Friction rings 66 are employed in conjunction with the faster 64 so that one friction ring 66 is provided on either side of the opening 70. The friction rings 66 allow the female threaded tapered collar 23B to be rotated relative to both of the bar pieces 22B' and 22B" while the bar pieces 22B' and 22B" remain stationary relative to each other and to the side walls 16 of the shower enclosure 18. The plug 68 is secured within the larger bar 22B" by means of one or more convex protrusions 74 provided on the internal surface 76 of the larger bar 22B" that engage concave indentations 78 provided on the external surface 80 of the plug 68.

The male threaded piston 62 is slidably engaged to an enlarged head 82 that is permanently secured within the smaller bar 22B' so that the male threaded piston 62 and the enlarged head 82 remain stationary relative to the smaller bar piece 22B'. The head 82 is secured within the smaller bar 22B' by convex protrusions 84 on the interior surface 86 of the smaller bar 22B' that engage corresponding concave indentations 88 provided on the exterior surface 90 of the head 82.

In order to install the second alternate embodiment 10B within the enclosure 18, the screw mechanism 60 is used to increase the total length 52 of the second alternate embodiment 10B by rotating the female threaded tapered collar 23B relative to the bar pieces 22B' and 22B", so that the bar pieces 22B' and 22B" move away from each other without rotation of either bar piece 22B' or 22B". To remove the second alternate embodiment 10B from the enclosure 18, this procedure is reversed, i.e. the female threaded tapered collar 23B is rotated in an opposite direction to move the bar pieces 22B' and 22B" toward each other, thereby shortening the u-shaped bar 22B.

Figure 7:
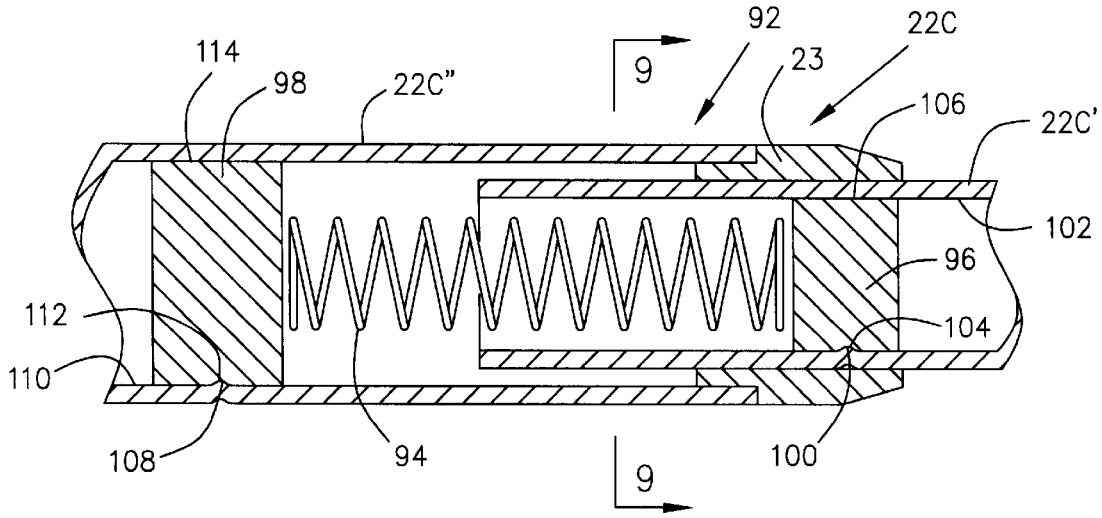
FIG. 7 is a cross sectional view of the circled area assigned the numeral 7 in FIG. 5, showing an alternate spring loaded adjustment mechanism.
Figure 9:
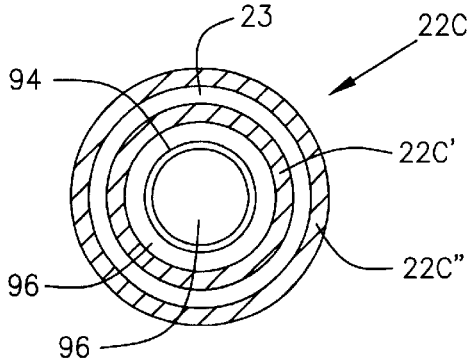
FIG. 9 is a cross sectional view of the spring loaded adjustment mechanism taken along line 9—9 of FIG. 7.

The third alternate embodiment 10C employs a u-shaped bar 22C that is adjusted in length 52 by means of a spring mechanism 92 provided within the bar 22C. Referring now to FIGS. 7 and 9, details of the spring mechanism 92 are illustrated.

The u-shaped bar 22C is comprised of two bar pieces 22C' and 22C" with the smaller bar 22C' inserting inside the larger hollow bar 22C" and adjustably positioned relative to the larger bar 22C" by a spring 94 that pushes against plugs 96 and 98 provided, respectively, within the bars 22C' and 22C".

The first plug 96 is secured within the smaller bar 22C' by means of one or more convex protrusions 100 provided on the internal surface 102 of the smaller bar 22C' that engage concave indentations 104 provided on the external surface 106 of the first plug 96.

Likewise, the second plug 98 is secured within the larger bar 22C" by means of one or more convex protrusions 108 provided on the internal surface 110 of the larger bar 22C" that engage concave indentations 112 provided on the external surface 114 of the second plug 98.

The third alternate embodiment 10C is provided with a tapered collar 23 identical to the tapered collar 23 of the first alternate embodiment 10A. The tapered collars 23 of these two embodiments, i.e. 10A and 10C, allow ring type shower curtain clamps 26 to glide smoothly and over the intersections of the two piece unshaped bars 22A and 22C.

In order to install the third alternate embodiment 10C within the enclosure 18, the spring mechanism 92 is used. The spring 94 is first compressed by pushing the bars 22C' and 22C" toward each other to decrease the total length 52 of the rod 10C so that the rod 10C can be inserted between opposing side walls 16 of the enclosure 18. Then the bars 22C' and 22C" are released, allowing the spring 94 to increase the total length 52 of the third alternate embodiment 10C by spring action so that the bars 22C' and 22C" are biased away from each other. To remove the third alternate embodiment 10C from the enclosure 18, this procedure is reversed, i.e. the spring is compressed to decrease the length 52 of the rod 10C so that it can be removed from the opposing side walls 16 of the enclosure 18.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A shower curtain rod comprising:

a single u-shaped bar extending between opposite side walls of a shower enclosure so that the bottom of the u-shaped bar extends outward toward an open side of the shower enclosure, means for securing the u-shaped bar to the opposite side walls of the shower enclosure provided on the u-shaped bar, said bar formed of two bar pieces that can be moved relative to each other so that the bar is adjustable in length, a J-shaped portion provided on each end of the u-shaped bar, said u-shaped bar comprising a bottom portion having a leg laterally extending from each end of said bottom portion and further comprising a J-shaped portion attached to and laterally extending from the other end of each leg such that a leg of the J-shaped portion extends generally parallel to said laterally extending leg, and at least two feet provided on each J-shaped portion for removably engaging opposite side walls of the shower enclosure.

2. A shower curtain rod comprising:

a single u-shaped bar extending between opposite side walls of a shower enclosure so that the bottom of the u-shaped bar extends outward toward an open side of the shower enclosure, means for securing the u-shaped bar to the opposite side walls of the shower enclosure provided on the u-shaped bar, said bar formed of two bar pieces that can be moved relative to each other so that the bar is adjustable in length, a J-shaped portion provided on each end of the u-shaped bar, said u-shaped bar comprising a bottom portion having a leg laterally extending from each end of said bottom portion and further comprising a J-shared portion attached to and laterally extending from the other end of each leg such that a leg of the J-shaped portion extends generally parallel to said laterally extending leg, and at least two feet provided on each J-shaped portion for removably engaging opposite side walls of the shower enclosure, and a spring mechanism provided within the bar for moving the two bar pieces of the bar relative to one another in order to adjust the length of the bar.

3. A shower curtain rod comprising:

a u-shaped bar extending between opposite side walls of a shower enclosure so that the bottom of the u-shaped bar extends outward toward an open side of the shower enclosure, means for securing the u-shaped bar to the opposite side walls of the shower enclosure provided on the u-shaped bar, and a flexible ear provided on each end of the u-shaped rod for removably retaining a ring type shower curtain clamp on one side of the ear in order to hold an attached shower curtain closed by holding side edges of the curtain so that the side edges hang against the opposite side walls of the shower enclosure.

* * * * *